US005592981A

United States Patent [19]

Derecktor

[11] Patent Number: 5,592,981

[45] Date of Patent: Jan. 14, 1997

[54] PORTABLE WORK BENCH HAVING SLIDING CONNECTIONS FOR RELEASABLY AND ADJUSTABLY ATTACHING ACCESSORIES THERETO

[75] Inventor: Thomas E. Derecktor, Fall River, Mass.

[73] Assignee: TracRac, Inc., Fall River, Mass.

[21] Appl. No.: 552,601

[22] Filed: Nov. 3, 1995

[51] Int. Cl.[6] ..... B25H 1/00

[52] U.S. Cl. ..... 144/286.1; 83/452; 83/468.7; 144/286.5; 144/287; 269/901; 296/3

[58] Field of Search ..... 182/181; 269/139, 269/321 CF, 901; 83/452, 468.7, 471.2, 471.3, 485, 574, 859; 144/286 R, 286 A, 287, 286.1, 286.5

[56] References Cited

U.S. PATENT DOCUMENTS

| | | | |
|---|---|---|---|
| 3,229,994 | 1/1966 | Klein . | |
| 3,406,728 | 10/1968 | Rost | 144/286 R |
| 3,762,762 | 10/1973 | Deshores . | |
| 3,901,548 | 8/1975 | Seaman, Jr. . | |
| 4,215,894 | 8/1980 | Sidlinger . | |
| 4,341,247 | 7/1982 | Price | 144/287 |
| 4,398,763 | 8/1983 | Louw . | |
| 4,527,786 | 7/1985 | Hsu | 269/901 |
| 4,527,827 | 7/1985 | Maniscalco et al. . | |
| 4,650,383 | 3/1987 | Hoff . | |
| 4,864,941 | 9/1989 | Goulter | 269/901 |
| 4,969,784 | 11/1990 | Yanke . | |
| 4,974,898 | 12/1990 | Baranski . | |
| 5,002,324 | 3/1991 | Griffin . | |
| 5,052,739 | 10/1991 | Irwin . | |
| 5,067,535 | 11/1991 | Wolff | 144/286 R |
| 5,137,320 | 8/1992 | Christensen . | |
| 5,139,375 | 8/1992 | Franchuk . | |
| 5,143,415 | 9/1992 | Boudah . | |
| 5,152,570 | 10/1992 | Hood . | |
| 5,190,337 | 3/1993 | McDaniel . | |
| 5,203,603 | 4/1993 | Hertzberg et al. . | |
| 5,238,280 | 8/1993 | Christensen . | |
| 5,301,726 | 4/1994 | Wojcik | 83/452 |
| 5,303,858 | 4/1994 | Price . | |
| 5,310,238 | 5/1994 | Wheatley . | |
| 5,316,190 | 5/1994 | Bullock . | |
| 5,393,114 | 2/1995 | Christensen . | |
| 5,443,554 | 8/1995 | Robert | 83/468.7 |
| 5,494,327 | 2/1996 | Derecktor | 296/3 |

FOREIGN PATENT DOCUMENTS

| | | | |
|---|---|---|---|
| 2276114 | 9/1994 | United Kingdom | 144/286 R |

*Primary Examiner*—W. Donald Bray
*Attorney, Agent, or Firm*— Salter & Michaelson

[57] ABSTRACT

A portable work bench includes a track having an elongate tubular body having a thin wall which defines substantially the entire outer perimeter of the tubular body. The thin wall has a bottom wall and a top wall opposite the bottom wall, and at least one rail member attached to the tubular body and extendable along the length of the body. The work bench further includes legs for supporting the track in an elevated position above a surface. A sliding lock assembly is releasably attachable to the rail member. The sliding lock assembly has a sliding lock member slidably mounted on the rail member of the track and movable along the length of the rail member. Thumb turn members are provided for locking the sliding lock member at a desired position along the length of the rail member.

17 Claims, 4 Drawing Sheets

PORTABLE WORK BENCH HAVING SLIDING CONNECTIONS FOR RELEASABLY AND ADJUSTABLY ATTACHING ACCESSORIES THERETO

BACKGROUND AND SUMMARY OF THE INVENTION

This invention relates generally to portable work benches, and more particularly to a portable work bench having sliding connections for releasably and adjustably attaching multiple accessories, such as saw mounts, extension stops, and the like, thereto.

This invention is primarily directed to a work bench having sliding connections for releasably and adjustably attaching accessories, such as a saw mounts, an extension stop and other types of mounts, to the work bench. Prior art portable work benches are typically fabricated from steel and molded plastic, and are bulky and difficult to transport. For example, one known work bench is fabricated nearly completely from steel and has a saw mount which is fixedly attached to the bench. Thus, when mounting the saw to the saw mount, the user of the work bench has no options as to where to place the saw thereby limiting the overall versatility of the work bench. There is presently a need for a work bench that is capable of mounting its component parts at varying locations thereon.

Accordingly, among the several objects of the present invention are the provision of an improved portable work bench having sliding connections for releasably and adjustably attaching accessories, such as a saw mount, to the work bench; the provision of such a work bench having sliding connections which is sturdy in design and lightweight; the provision of such a work bench which can be broken down to a compact configuration suitable for transport or storage; the provision of such a work bench having sliding connections with a plurality of rail members on each track which receive sliding members for mounting various accessories to the work bench, the accessories being slidably movable along their respective rail member independently from the work bench; the provision of such a work bench which is adjustable heightwise; and the provision of such a work bench having sliding connections which is easy to manufacture and durable in use.

In general, the present invention is directed to a portable work bench comprising a track having an elongate tubular body comprising a thin wall, which defines substantially the entire outer perimeter of the tubular body. The tubular body has a bottom wall and a top wall opposite the bottom wall, and at least one rail member attached to the tubular body and extendable along the length of the body. The work bench further comprises support means for supporting the track in an elevated position above a surface. A sliding lock assembly is releasably attachable to the rail member. The sliding lock assembly comprises a sliding lock member slidably mounted on the rail member of the track and movable along the length of the rail member. Means is provided for locking the sliding lock member at a desired position along the length of the rail member.

More specifically, the rail member of the track is generally rectangular in cross section, and the sliding lock member of the sliding lock assembly is generally C-shaped in cross section. The sliding lock member has a bearing plate with a relatively large surface area and a pair of inwardly formed fingers which define an elongate receiving channel sized for receiving the rail member therein. The locking means of the sliding lock assembly comprises a threaded opening formed in the sliding lock member and a stud threadably received in the threaded opening. The stud is adapted to engage the rail member of the track when tightening the stud for locking the sliding lock member to the track. The locking means further includes a thumb turn member or knob attached at an upper end of the stud for facilitating the turning of the stud by hand when moving the stud into locking engagement with the rail member when tightening the stud.

The track further includes a second rail member mounted on the elongate tubular body wherein the first and second rail members are mounted on the top wall of the elongate tubular body. The sliding lock member of the sliding lock assembly is modified to comprise a plate having a top surface adapted to support an accessory thereon and a bottom surface adapted for engaging the first and second rail members. Means for locking the sliding lock member comprises an elongate locking member received between the first and second rail members in such a manner that inner edge portions of the first and second rail members are engageable with the elongate locking member. Means is provided for moving the elongate locking member in clamping relation with the first and second rail members. The arrangement is such that when employing the means for moving the elongate locking member, the first and second rail members are clamped between the plate and elongate locking member for securely retaining the modified sliding lock assembly to the first and second rail members. The moving means comprises a threaded bolt extending through aligned openings formed in the plate and elongate locking member and a thumb turn member threadably attached at an end of the bolt, whereby upon tightening the thumb turn member, the elongate locking member is raised in clamping arrangement against the first and second rail members.

Two pairs of legs are provided for locating the track at a desired elevation. One pair of legs is mounted by mounting means to the track at one end thereof and the other pair of legs is mounted by the mounting means at the other end thereof. The means mounting comprises, for each pair of legs, a screw fastener having a head portion which is completely disposed within the tubular body of the track and a thread portion which attaches the track to at least one bracket connected to the legs. The mounting means further comprises another bracket pivotally connected to a sliding member at one end thereof, the sliding member being slidably attached at its other end to at least one of the legs of the pair of legs for adjustably locating the track at a desired elevation.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
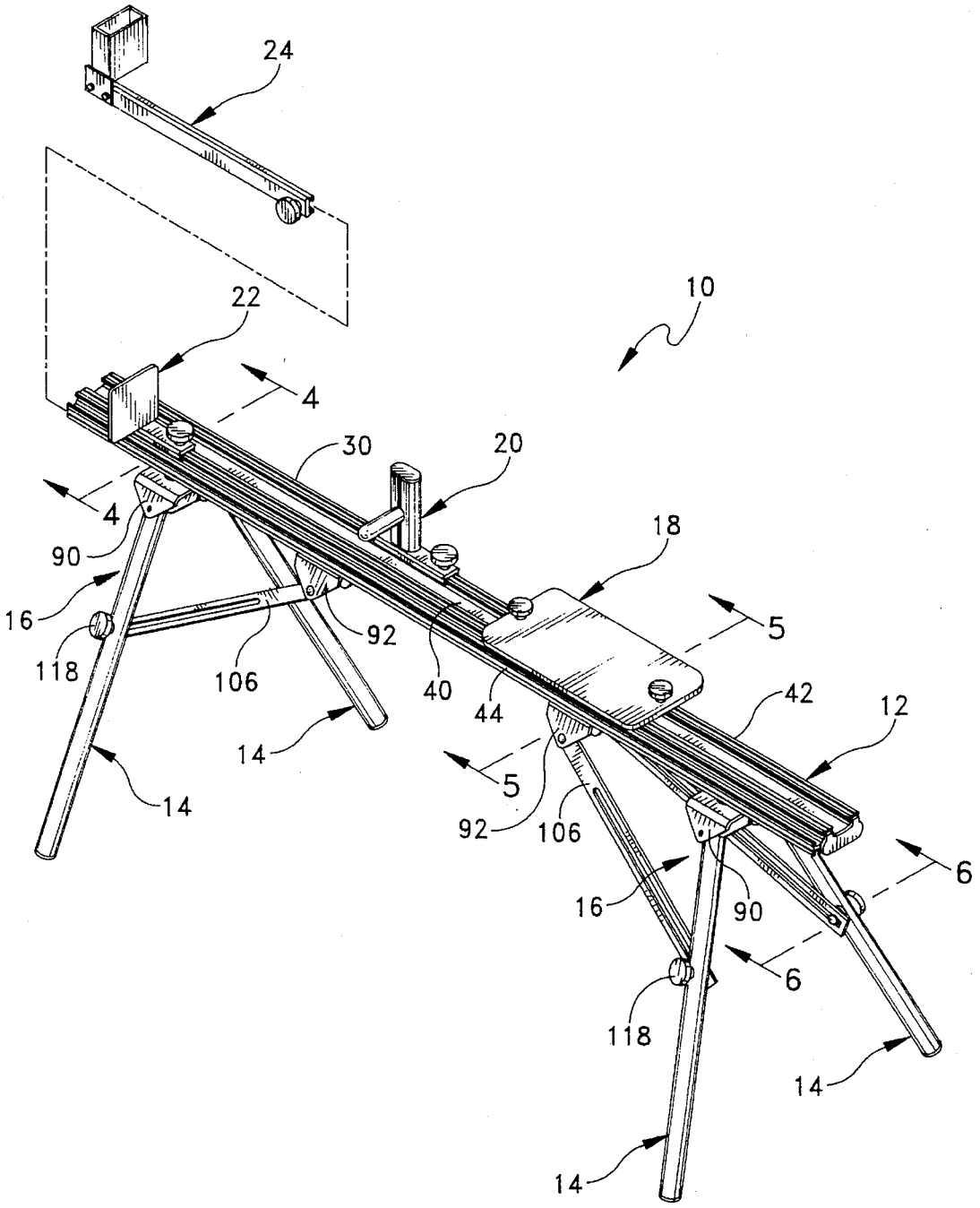
FIG. 1 is a perspective view of a portable work bench of the present invention.

Referring now to the drawings, and more particularly to FIG. 1, there is generally indicated at 10 a work bench of the present invention having sliding connections for releasably and adjustably attaching multiple accessories thereto. The work bench 10 is especially suited for portable use since it can be broken down to a compact configuration and easily assembled to achieve a use configuration when it is desired to use it. As illustrated in FIG. 1, the work bench 10 comprises an elongate track, generally indicated at 12, four legs, each generally indicated at 14, a pair of legs being located at each end of the track 12, and means for mounting the legs 14 to the track 12, generally indicated at 16.

The work bench 10 further comprises multiple accessories, including a saw mount, generally indicated at 18, an adjustable work support, generally indicated at 20, a work stop, generally indicated at 22, and an extension work stop, generally indicated at 24, which are mounted on the track 12. The track 12 is a structural member designed to carry the loads applied thereon by the accessories. The saw mount 18 is designed to receive a portable saw (not shown) thereon in the manner well known in the art. The adjustable work support 20 is provided for supporting items to be cut by the portable saw, such as lumber. And the work stop 22 and extension work stop 24 provide an engagement surface which engages the ends of items during cutting so as to establish cutting lengths, for example. The work bench 10 of the present invention enables its user to adjust the location of these accessories so as to more efficiently utilize the entire length of the track 12 of the work bench 10. For example, by placing the saw mount 18 (and saw) at one end of the track 12, the work support 20 in the middle of the track 12, and the work stop 22 or extension work stop 24 at the other end of the track 12, the user of the work bench 10 can cut (or manipulate with some other tool) a piece of lumber which is relatively long. Moreover, since the work bench 10 is portable, it can be broken down to a compact configuration and transported easily to another work site.

Referring to FIGS. 2–5, the track 12 of the work bench 10 has an elongate, structural tubular body 30 comprising a thin wall which defines substantially the entire outer perimeter of the tubular body 30. The tubular nature of the track 12 of the work bench 10 enables it to withstand substantial amounts of torsional and lateral loads applied thereto. It should be noted that other structural members, such as I-beams, channel members, and the like can be used instead of the tubular body 30. However, the tubular body 30 is light-weight while maintaining its durability. The tubular body 30 includes a bottom wall 32, a top wall 34 opposite the bottom wall 32, and a pair of side walls 36, 38 which interconnect the top and bottom walls 34, 36. Integrally formed with the elongate tubular body are three rail members 40, 42 and 44, each being designed to receive and attach the adjustable work support 20, work stop 22 and extension work 24 stop thereon. Each rail member 40, 42 and 44 is generally rectangular in cross section and extends along the length of the tubular body 30. It should be understood that any number of rail members may be provided on the track 12, such as two rail members, and that the provision of three rail members gives the user added versatility for mounting other items onto the work bench. As shown, the first and second rail members 40, 42 are mounted on the top wall 34 of the elongate tubular body 30 and the third rail member is mounted on side wall 36 of the body 30. Preferably, the track 12 is fabricated from extruded aluminum which has been found to be light-weight, easy to manufacture and strong in construction. However, the track 12 can also be made from materials other than aluminum exhibiting the characteristics of aluminum (e.g., strong, light-weight).

Figure 4:
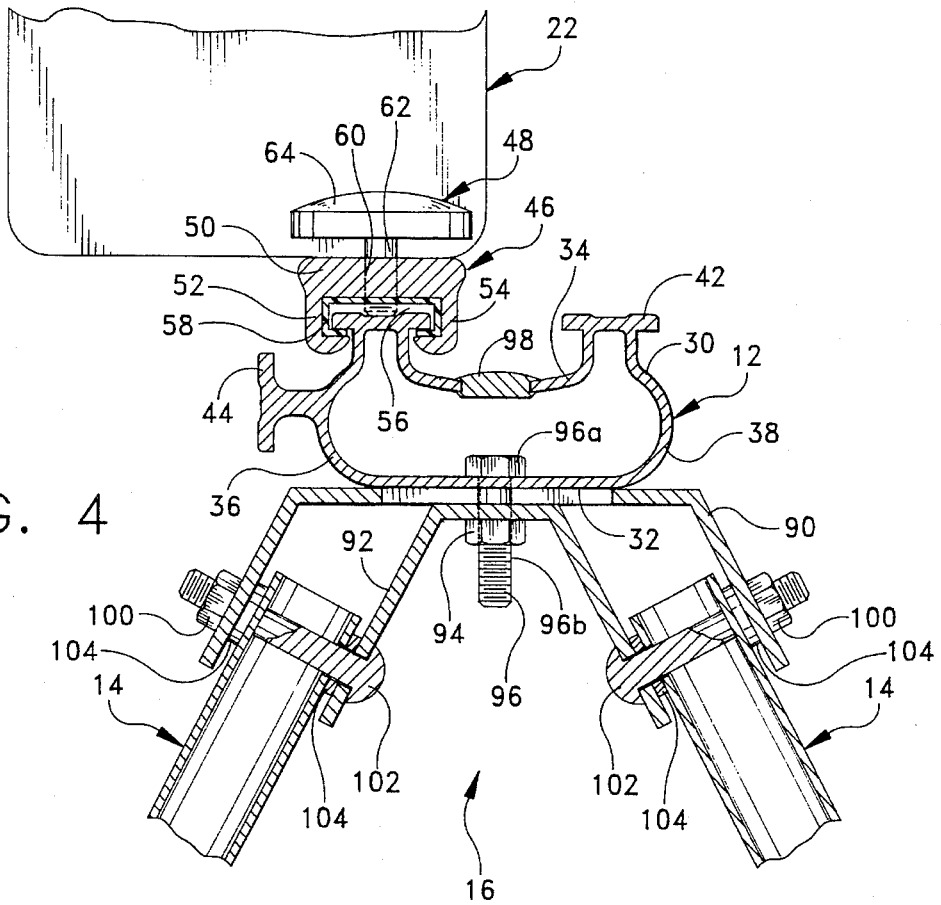
FIG. 4 is a cross-sectional view taken along line 4—4 of FIG. 1.

Turning now to FIGS. 1 and 4, and more particularly to FIG. 4, the work support 20, work stop 22, and extension work stop 24 each define a sliding lock assembly which is releasably attachable to one of the rail members. Each of these accessories comprises a sliding lock member generally indicated at 46 which is slidably mounted on the rail member 40, 42 or 44 of the track 12 and movable along the length of the rail member, and means for locking the sliding lock member to the rail member generally indicated at 48 at a desired position along the length of the rail member. As shown in FIG. 4, the sliding lock member 46 of the adjustable work stop 22 (and for the work support 20 and extension work stop 24 since they are of nearly identical construction) is of generally C-shaped construction in cross section, and has an elongate rail bearing member 50 with a bearing surface area for engaging the rail member (e.g., rail member 40 in FIG. 4) and a pair of inwardly formed fingers 54, 56 which define an elongate receiving channel 56 sized for receiving the rail member 40 therein. The arrangement is such that the sliding lock member 46 is attached to the rail member 40 of the track 12 by slipping the lock member 46 over the track 12 in a position where the rail member 40 occupies the channel 56 of the lock member. Provided within the elongate receiving channel 56 of the sliding lock member is a plastic insert 58 for facilitating the sliding movement of the sliding lock member 46 over the rail member 40.

For locking the sliding lock member 46 in place, the locking means 48 of the adjustable work support 20, work stop 22 and extension work stop 24 comprises a threaded opening 60 formed in the rail bearing member 50 of the sliding lock member 46 and a threaded stud 62 threadably received in the threaded opening 60. The stud 62 is positioned so as to engage the rail member (e.g., rail member 40 in FIG. 4) of the track 12 when tightening the stud 62 thereby locking the sliding lock member 46 in place along the rail member of the track. For turning the threaded stud 62, a thumb turn member 64 is attached at the upper end of the stud 62. The thumb turn member 64 facilitates the turning of the stud 62 by hand for moving it into locking engagement with the rail member 40. The thumb turn member 64 can be easily grasped within a person's hand. It has been found that this arrangement provides a strong attachment of the sliding lock member 46 to the rail member 40 of the track 12 while being easy to unlock and change the location of the member 46. The lower end of the stud 62 can be provided with a plastic tip (not shown) for engaging the rail member 40 of the track 12. The plastic tip substantially prevents the stud 62 from gouging the rail member 40.

Figure 5:
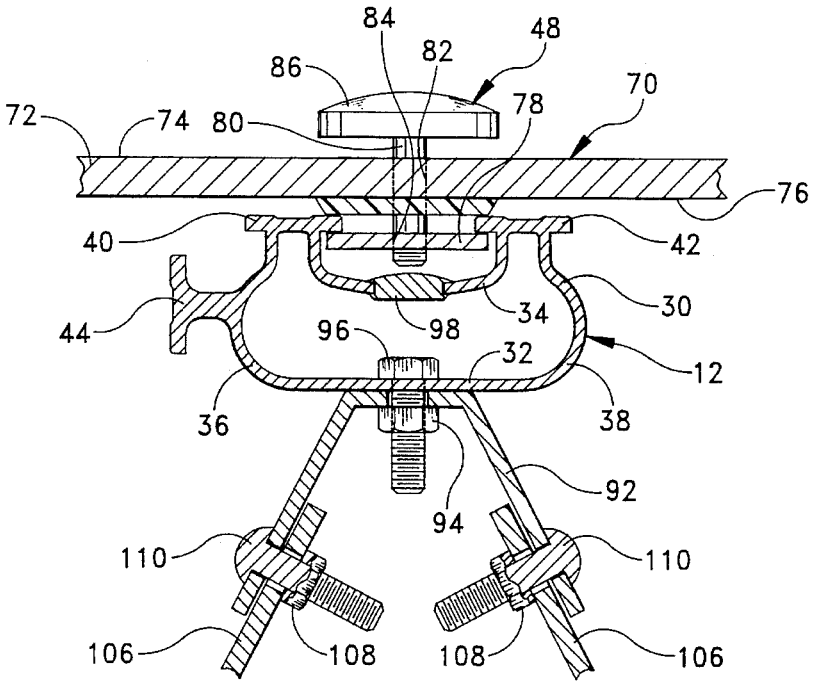
FIG. 5 is a is a cross-sectional view taken along line 5—5 of FIG. 1.
Figure 6:
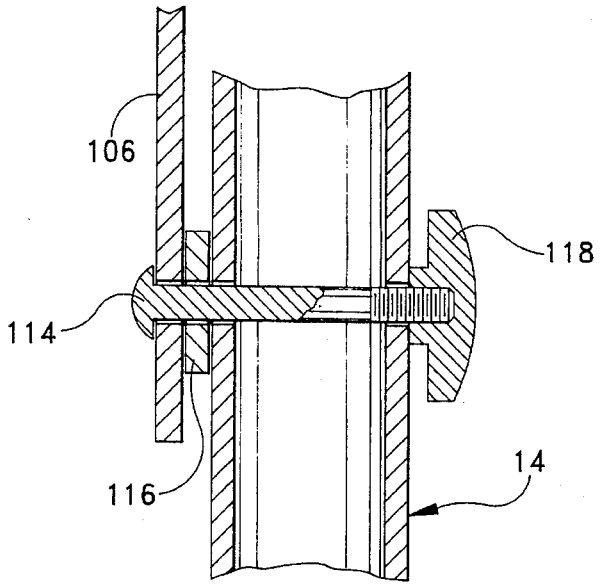
FIG. 6 is a is a cross-sectional view taken along line 6—6 of FIG. 1.

Turning to FIGS. 1 and 5, a modified sliding lock assembly is provided for mounting the saw mount 18 on the track 12. The modified sliding lock assembly comprises a sliding lock member indicated generally at 70 having a plate 72 with an upwardly facing surface 74 adapted to engage and support the saw thereon and a downwardly facing surface 76 for engaging the first and second rail members 40, 42. Since the plate 72 is wider than the sliding lock member 46 of sliding lock assembly for the adjustable work support 20, work stop 22 and extension work stop 24, it is especially suited for mounting thereon relatively large items, for example, a table saw. The modified sliding lock assembly further comprises as its locking means an elongate locking member 78 which is received between the first and second rail members 40, 42 in such a manner that the inner edge portions of the first and second rail members 40, 42 are in engagement with the elongate locking member 78.

Further provided is means for moving the elongate locking member 78 in clamping relation with the first and second rail members. The moving means comprises a threaded bolt 80 extending through aligned openings 82, 84 formed in the plate 72 and elongate locking member 78, respectively, and a thumb turn member 86 threadably attached to an end of the bolt 80. The opening 82 formed in the plate 72 is a clearance opening whereas the opening 84 formed in the locking member 78 is a tapped opening. The arrangement is such that when tightening the thumb turn member 86, the first and second rail members 40, 42 are clamped between the plate 72 and the elongate locking member 78 for securely retaining plate 72 the modified sliding lock assembly in place.

The legs 14 are attached to the track 12 in such a manner that the height of the track 12 is vertically adjustable at a desired elevation so as to accommodate the user of the work bench. Turning now to FIGS. 2–4, 6 and 7, each pair of legs 14 (broadly referred to as "support means") are attached by one large bracket 90 and two small brackets 92. To attach the legs 4 to the track 12, one large bracket 90 and one small bracket 92 are attached to the bottom wall 32 of the track 12 in the manner illustrated in FIGS. 2 and 3 by a pair of nut and bolt fasteners 94, 96, with the smaller bracket 92 being received in the large bracket 90. As illustrated in FIG. 4, the head portion **96*a* of each bolt fastener 96 is completely disposed within the tubular body 30 of the track 12, and the thread portion 96*b* of each bolt fastener 96 threadably engages the nut 94 for securing the brackets 90, 92 to the track 12. Suitable plugs 98 block the openings (not designated) in the top wall 34 of the body 30 used to access the head portions 96*a* of each bolt fastener 96**.

Figure 3:
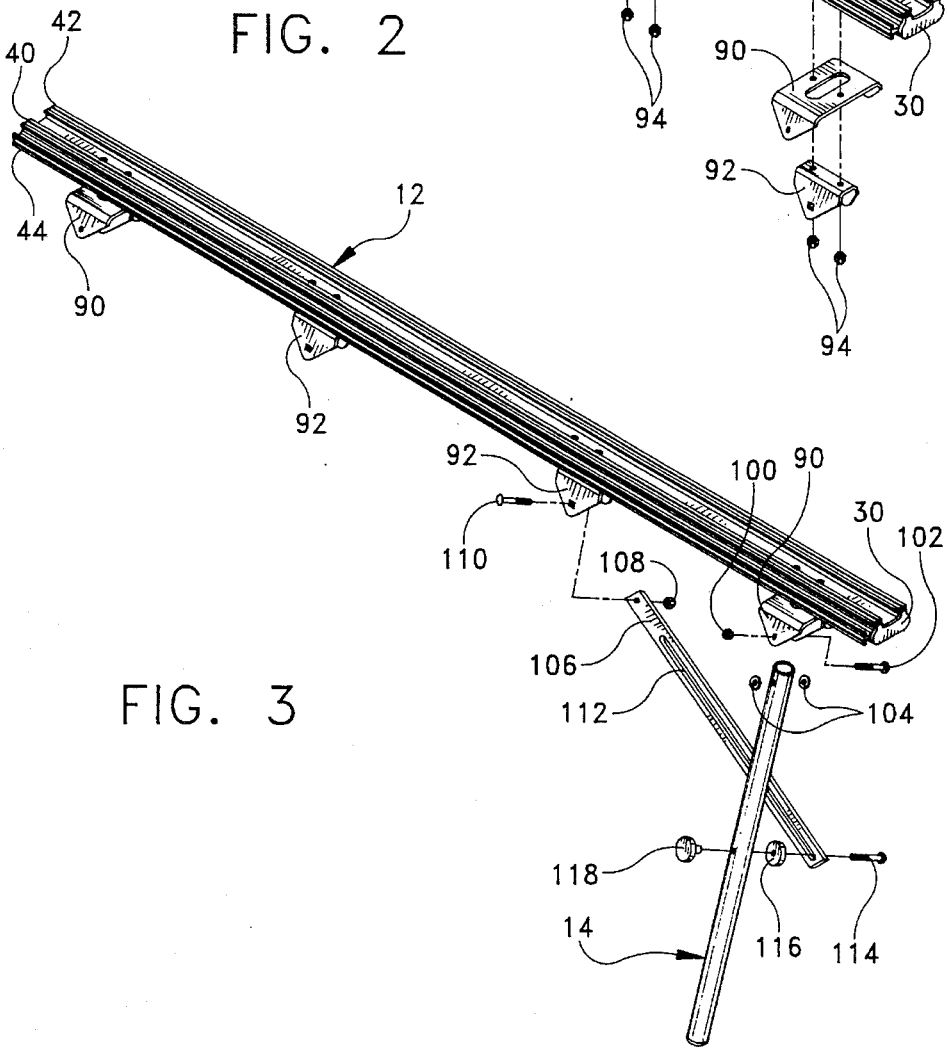
FIG. 3 is an exploded perspective view of the attachment of a leg, to the track.
Figure 7:
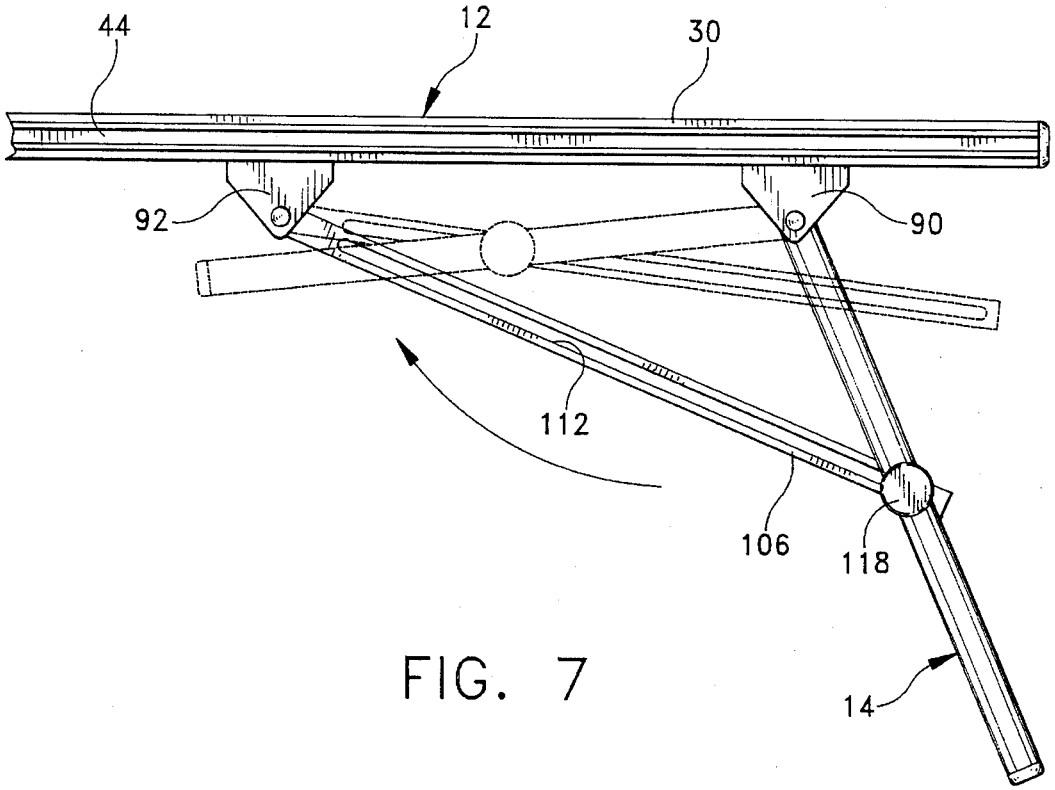
FIG. 7 is a side elevational view of the swinging movement of a leg of the work bench between an extended position (illustrated by solid lines) and a retracted position (illustrated by broken lines).

As illustrated in FIGS. 4 and 7, the legs 14 are pivotally connected to the body 30 of the track 12 by the brackets 90, 92 between a collapsed position which is illustrated by broken lines in FIG. 7, and an extending or use position which is illustrated by solid lines in FIG. 7. FIGS. 3 and 4 show each leg 14 being attached to the brackets 90, 92 by a nut and bolt fastener 100, 102, along with a pair of washers 104 disposed therebetween.

Figure 2:
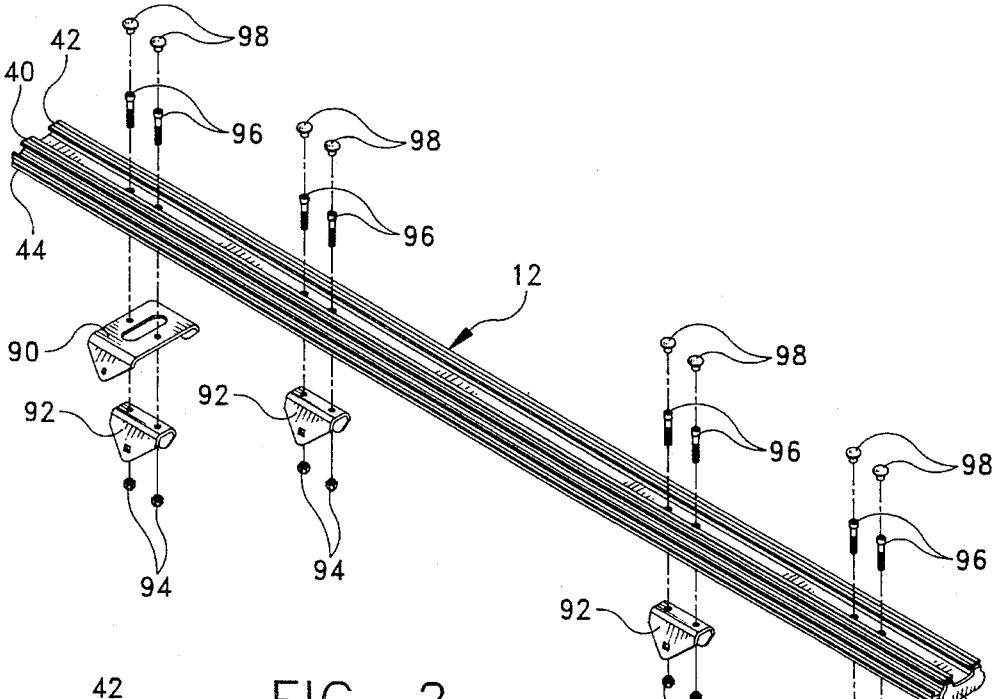
FIG. 2 is an exploded perspective view of a track and leg brackets of the work bench before the leg brackets are attached to the track.

For locking each pair of legs 14 in place, a pair of sliding members, each indicated at 106, one for each leg 14, are mounted by the other smaller bracket 92 to the bottom wall 34 of the body 30 of the track 12 by suitable fasteners 94, 96 (see FIGS. 2 and 5). Each sliding member 106 is pivotally attached to the smaller bracket 92 by another nut and bolt fastener 108, 110 at one end thereof, and is slidably attached at its other end to its respective leg 14. More specifically, each sliding member 106 has an elongate slot 112 formed therein which receives another bolt fastener assembly for securely fastening the sliding member 106 to the leg 14 in the manner illustrated in FIG. 6. As shown, each assembly comprises a bolt 114, a washer 116, and a thumb turn member 118 threadably attached at the other end of the bolt 114 for locking the leg 14 in place by hand. Thus, it should be observed, that the height of the track 12 of the work bench 10 can be adjusted by hand by loosening and tightening the thumb turn members 118 and pivoting the legs 14 at a desired angular relation to the track so as to achieve a desired height.

It should be noted that the sliding connections of the present invention provide strong connections for mounting the accessories onto the track of the work bench 10. It should also be noted that the connections allow for the easy attachment to, adjustment of, and removal of the accessories to the track 12 of the work bench without any loss of strength or durability. Furthermore, the construction of the legs 14 and mounting means 16 enables the user of the work bench 10 to vertically adjust its height to meet the needs of the user of the work bench.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A portable work bench comprising:

a track having a structural body, and at least one rail member attached to the structural body and extendable along the length of the body;

support means for supporting the track in an elevated position above a surface; and a sliding lock assembly releasably attachable to the rail member, said sliding lock assembly comprising a sliding lock member slidably mounted on the rail member of the track and movable along the length of the rail member, and means for locking the sliding lock member at a desired position along the length of the rail member, said sliding lock member having means for mounting an accessory thereon.

2. A portable work bench as set forth in claim 1, said structural body being tubular, and comprising a thin wall which defines substantially the entire outer perimeter of the body, said tubular body having a bottom wall portion and a top wall portion opposite the bottom wall portion.

3. A portable work bench as set forth in claim 2 said rail member of the track being generally rectangular in cross section said sliding lock member of the sliding lock assembly being generally C-shaped in cross section, said sliding lock member having a rail bearing member with a relatively large surface area and a pair of inwardly formed fingers which define an elongate receiving channel sized for receiving the rail members therein.

4. A portable work bench as set forth in claim 2, said locking means comprising a threaded opening formed in the sliding lock member and a stud threadably received in the threaded opening, said stud being adapted to engage the rail member of the track when tightening said stud for locking the sliding lock member to the track.

5. A portable work bench as set forth in claim 4, said locking means further comprising a thumb turn member attached at an upper end of the stud, said thumb turn member facilitating the turning of the stud by hand for moving the stud into locking engagement with said rail member when tightening said stud.

6. A portable work bench as set forth in claim 3, said sliding lock assembly further comprising a plastic insert receivable within the elongate receiving channel of the sliding lock member for facilitating the sliding movement of the sliding lock member over the rail member.

7. A portable work bench as set forth in claim 2, said track further comprising a second rail member mounted on said elongate tubular body, said second rail member being adapted to receive a sliding lock assembly thereon.

8. A portable work bench as set forth in claim 7, said first and second rail members being mounted on said top wall portion of the elongate tubular body.

9. A portable work bench as set forth in claim 8, said sliding lock member of the sliding lock assembly comprising a plate having a top surface adapted to support an accessory thereon and a bottom surface adapted for engaging the first and second rail members.

10. A portable work bench as set forth in claim 9, said means for locking the sliding lock member comprising an elongate locking member received between the first and second rail members in such a manner that inner edge portions of the first and second rail members are engageable with the elongate locking member.

11. A portable work bench as set forth in claim 10 further comprising means for moving the elongate locking member in clamping relation with the first and second rail members, the arrangement being such that when employing said means for moving said elongate locking member, the first and second rail members are clamped between the plate and elongate locking member for securely retaining the modified sliding lock assembly to the first and second rail members.

12. A portable work bench as set forth in claim 11, said moving means comprising a threaded bolt extending through aligned openings formed in the plate and elongate locking member and a thumb turn member threadably attached at an end of the bolt, whereby upon tightening said thumb turn member, said elongate locking member being raised in clamping arrangement against the first and second rail members.

13. A portable work bench as set forth in claim 2, said support means being adjustable for locating said track at a desired elevation.

14. A portable work bench as set forth in claim 13, said support means comprising one pair of legs mounted by mounting means to said track at one end thereof and another pair of legs mounted by said mounting means at the other end thereof.

15. A portable work bench as set forth in claim 14, said means mounting said pairs of legs to said track each comprising a screw fastener having a head portion which is completely disposed within the tubular body of the track and a thread portion which attaches the track to at least one bracket connected to said legs.

16. A portable work bench as set forth in claim 15, said mounting means further comprising another bracket pivotally connected to a sliding member at one end thereof, said sliding member being slidably attached at its other end to at least one of the legs of said pair of legs for adjustably locating the track at a desired elevation.

17. A portable work bench as set forth in claim 7 further comprising a third rail member.

* * * * *